US006612628B1

(12) United States Patent
Herbst

(10) Patent No.: US 6,612,628 B1
(45) Date of Patent: Sep. 2, 2003

(54) ADJUSTING DEVICE FOR HINGED WINDOWS

(75) Inventor: Erich Herbst, Besigheim (DE)

(73) Assignee: Richard Fritz GmbH & Co. KG, Besigheim (DE)

( * ) Notice: Subject to any disclaimer, the term of this patent is extended or adjusted under 35 U.S.C. 154(b) by 0 days.

(21) Appl. No.: 09/937,283

(22) PCT Filed: Mar. 8, 2000

(86) PCT No.: PCT/EP00/01991

§ 371 (c)(1),
(2), (4) Date: Sep. 25, 2001

(87) PCT Pub. No.: WO00/60199

PCT Pub. Date: Oct. 12, 2000

(30) Foreign Application Priority Data

Mar. 30, 1999 (DE) ..... 199 14 423

(51) Int. Cl.[7] ..... E05C 17/32

(52) U.S. Cl. ..... 292/263; 16/324; 16/334; 292/271; 292/252

(58) Field of Search ..... 16/334, 324; 292/252, 292/263, 266, 271, 273

(56) References Cited

U.S. PATENT DOCUMENTS 3,093,258 A * 6/1963 Turner ..... 217/60
4,466,644 A * 8/1984 Wooten ..... 292/263
4,833,737 A * 5/1989 Boucher ..... 4/253

FOREIGN PATENT DOCUMENTS

| | | |
|---|---|---|
| DE | 24 08 889 | 9/1975 |
| EP | 0 047 826 | 3/1982 |
| FR | 1 206 819 | 2/1960 |
| GB | 2 169 953 | 7/1986 |

* cited by examiner

*Primary Examiner*—Gary Estremsky
(74) *Attorney, Agent, or Firm*—Foley & Lardner

(57) ABSTRACT

The invention relates to an adjusting device (20) for hinged windows (21) comprising, as components, a base body (25), a control element (26), an actuating lever (27), and a connecting bracket (28). These elements are connected to one another in twos and in an articulated manner by means of a hinged joint. The base body (25) is fastened with one end thereof to a body part (22). The connecting bracket is fastened with one end thereof to the hinged window (21). A detent device is preferably provided on the hinged joint (32) between the control element (26) and the actuating lever (27) and comprises a detent body and a detent notch. The detent body Is guided in a displaceable manner inside a longitudinal guide of the actuating lever (27) and is pressed, via a spring plate, against the control element (26) by means of a pressure spring. The control arm is provided with one or more detent notches.

11 Claims, 7 Drawing Sheets

ADJUSTING DEVICE FOR HINGED WINDOWS

Figure 1:
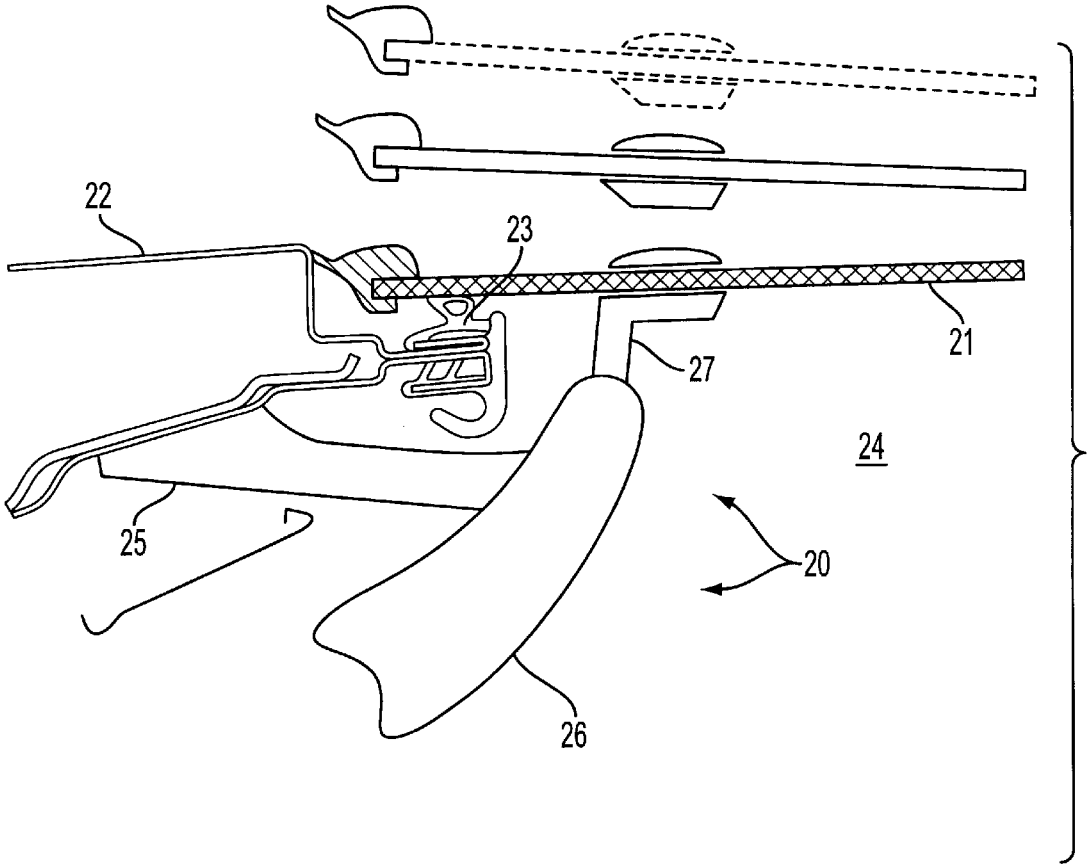

In motor vehicles, in particular in passenger vehicles, the side windows in the region of the rear seats are sometimes designed as hinged windows in order to allow draft-free ventilation during travel. These hinged windows may be adjusted between a closed position and at least one open position by means of an adjusting device.

The conventional adjusting devices have a four-part leverbar linkage comprising a basic body, a link, an actuating lever and a connecting strap. The basic body is connected, at one end, to part of the motor vehicle bodywork. The connecting strap is connected, at one end, to the hinged window. The link is connected in an articulated manner to the basic body by means of a first hinge joint and to the actuating lever by means of a second hinge joint. The actuating lever is connected in an articulated manner to the connecting strap by means of a third hinge joint. A latching device with at least two latching positions is provided on one hinge joint, to be precise generally on the first hinge joint between the basic body and the link.

The latching device has, as latching body, a cylindrical roller body, which is guided in a guide slot of the associated hinge part, said guide slot being coordinated with the cross-sectional shape of the roller body. The latching device has, for each latching position, a latching notch which is arranged on the other hinge part of the hinge joint in alignment with the movement path of the latching body. Arranged in the guide slot of the latching body is a pressure-exerting spring which subjects the latching body to a force in the direction of the latching notch, which is arranged in the other hinge part of the hinge joint. The latching notches are in the form of a hollow cylinder section.

The disadvantage of this latching device is that the clear width of the guide slot has to be sufficiently large in order for it to be possible for the roller-like latching body to move therein without jamming. This results in the latching body also having lateral play in each of its latching positions, and in the two hinge parts thus being able to move to a certain extent in relation to one another. This means that, in the open position in particular, the relative wind against the hinged window gives rise to vibratory movements, which in turn produce corresponding rattling noise. In the closed position of the hinged window, these vibratory movements and the resulting noise are only avoided when the seal of the hinged window produces a sufficiently large restoring force in the closed position.

The object of the invention is to provide an adjusting device for hinged windows in the case of which, in the open position of the hinged window in particular, vibratory movements and rattling noise are at least reduced or avoided altogether. This object is achieved by an adjusting device according to one of claims 1 to 4.

Since, in the case of the adjusting device according to claim 1 or claim 2, the latching notch has, in a plane aligned perpendicularly to the hinge axis of the hinge joint, a vertical projection or a section with two border lines positioned obliquely in relation to one another, two clearly defined abutment surfaces are provided for the latching body. Since, on the spring plate, the normals to the abutment surface for the latching body are inclined to a certain extent in relation to the alignment of the longitudinal guide of the latching body, the contact-pressure force of the pressure-exerting spring, at the same time, produces a force component which is aligned normal to the guide surface of the latching body and thus presses the latching body against the relevant guide surface of its guide slot and keeps it pressed against the same. Since the latching body butts, at the same time, against the two latching notch abutment surfaces, which are inclined in relation to one another, the latching body, and thus the entire hinge joint, is retained in a play-free manner in the relevant operating position.

Since, in the case of the adjusting device according to claim 3 or 4, the line of symmetry of the vertical projection of the latching notch is inclined by a certain angle in relation to the radial line from the hinge axis of said hinge joint, the two abutment surfaces of the latching notch subject the latching bodies to a reaction force in each case, of which the lateral force components are of different magnitudes. The resultant of these two lateral force components presses the latching body against one of the guide surface [[sic]] of its guide slot and keeps in pressed against the same. This also avoids vibratory movements and rattling noise of the adjusting device.

A configuration according to claim 5 achieves, on the one hand, optimization of the adjusting force for the adjustment of the hinged window from one operating position into the other, and on the other hand, there is sufficient retaining force in each of the operating positions.

A configuration according to claim 6 or 7 achieves a sufficiently large lateral force component, which is generally sufficient in order to avoid vibratory movements and corresponding rattling noise. This applies in particular to a development according to claim 8, in the case of which the adjusting force for closing the hinged window is greater than the force for opening the hinged window. As a result, even in the case of relatively high traveling speeds with greater wind forces against the hinged window, undesired slamming shut of the hinged window is avoided.

In the case of a configuration according to claim 9, in addition to the closed position, it is possible to achieve two open positions of the hinged window, the different center angles of the different positions of the latching notches taking account of the geometric relationships of the parts of the adjusting device in order to achieve at least more or less the same extent of adjustment of the hinged window between the two open positions.

In the case of a configuration according to claim 10, even with the latching body design of the latching ball, the production of the latching notches is very straightforward.

Figure 2:
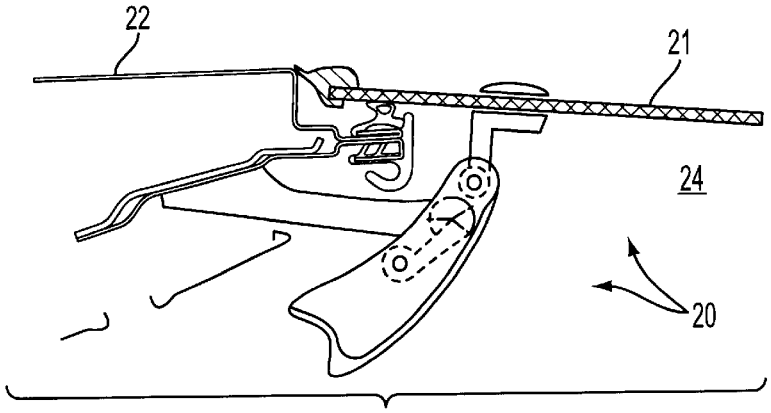
Figure 3:
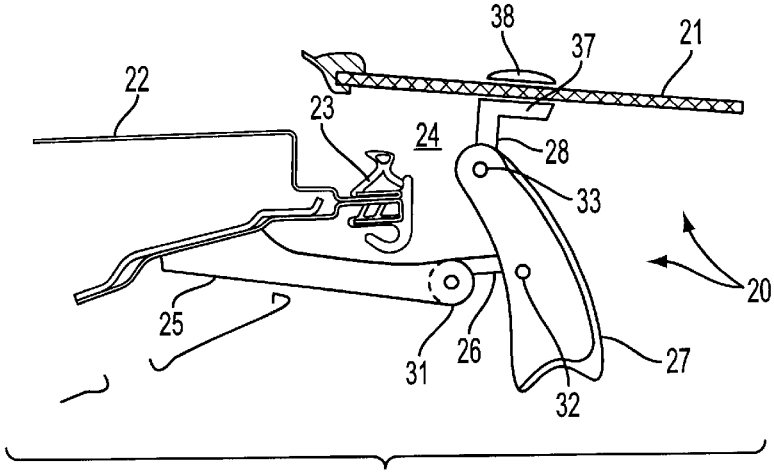
Figure 4:
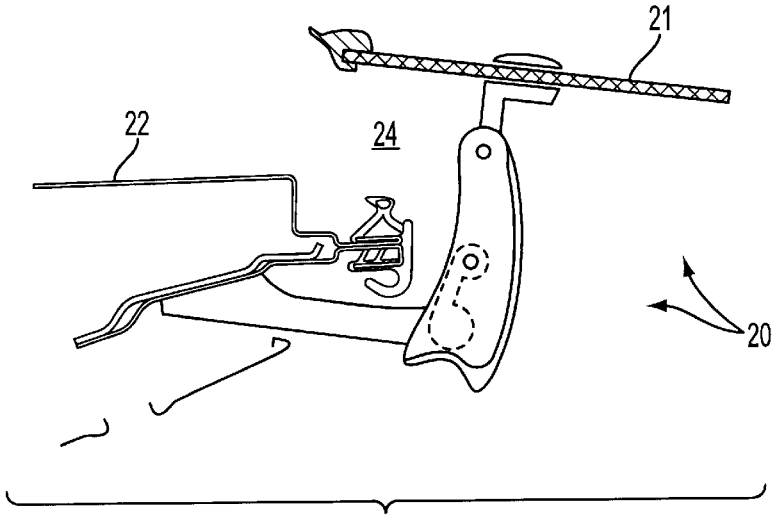
Figure 7:
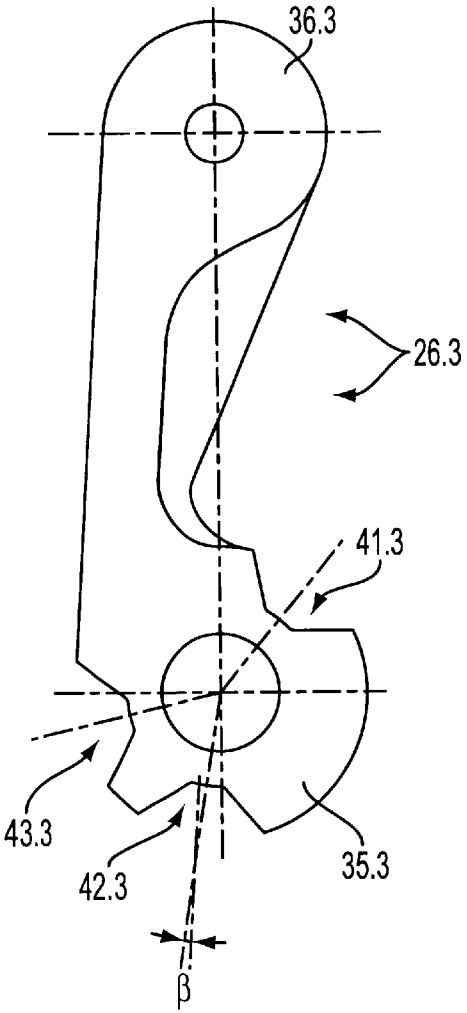
Figure 6:
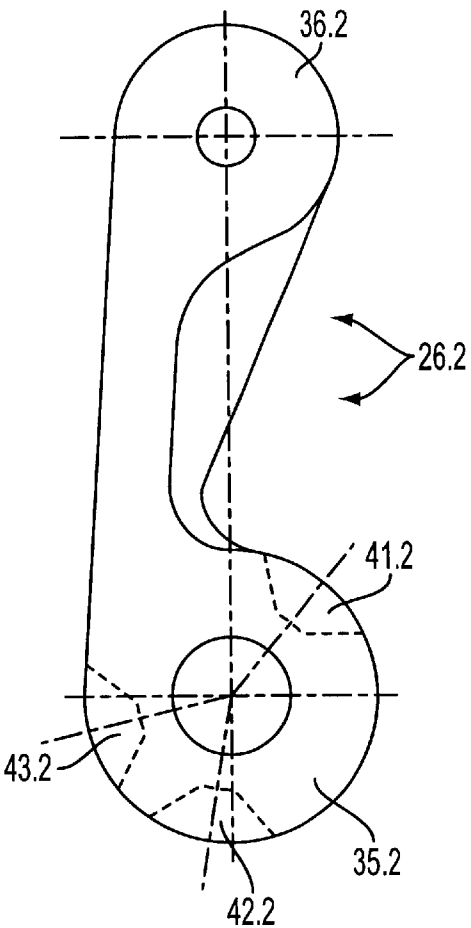
Figure 5:
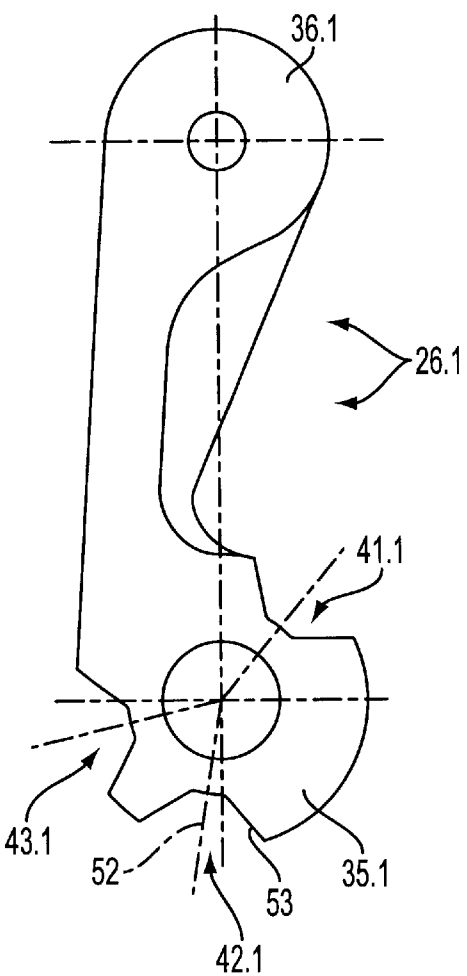
Figure 9:
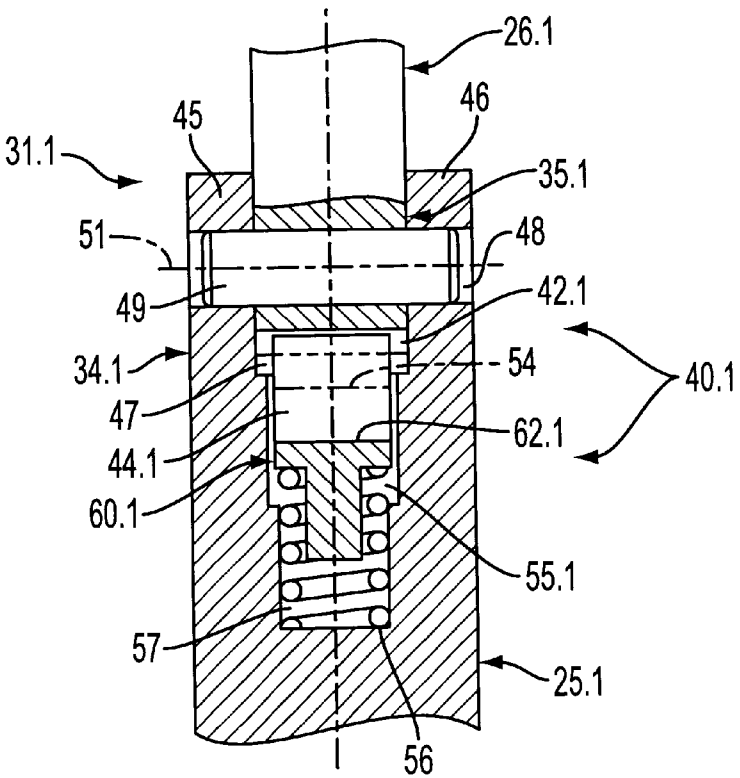
Figure 8:
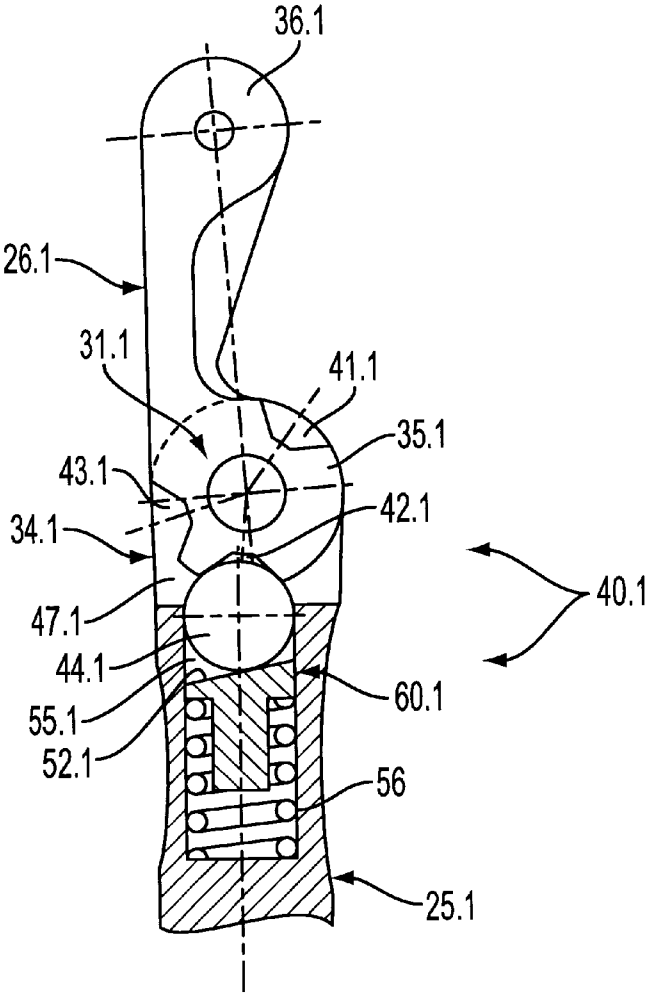
Figure 12:
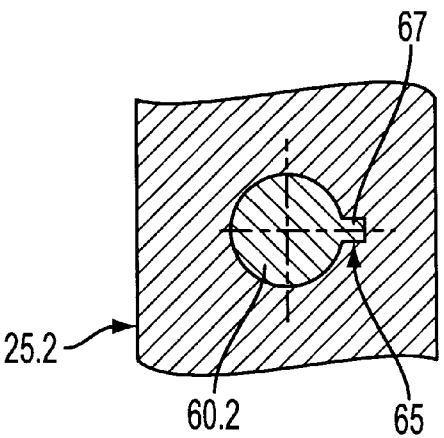
Figure 11:
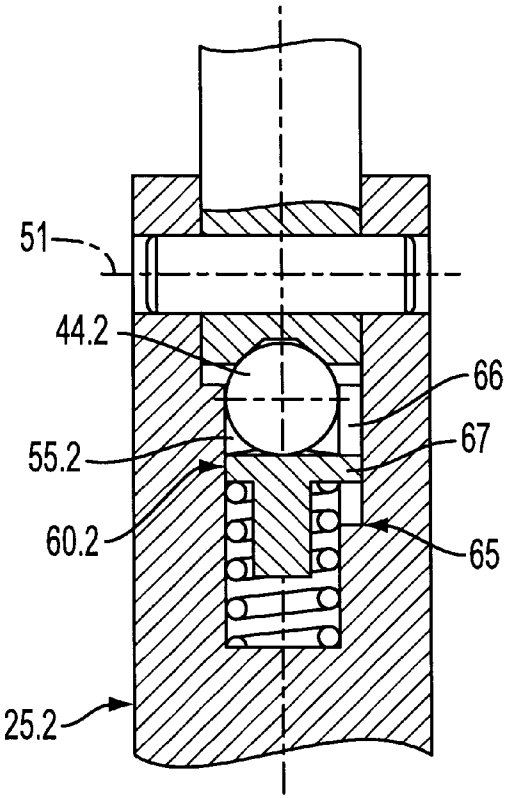
Figure 10:
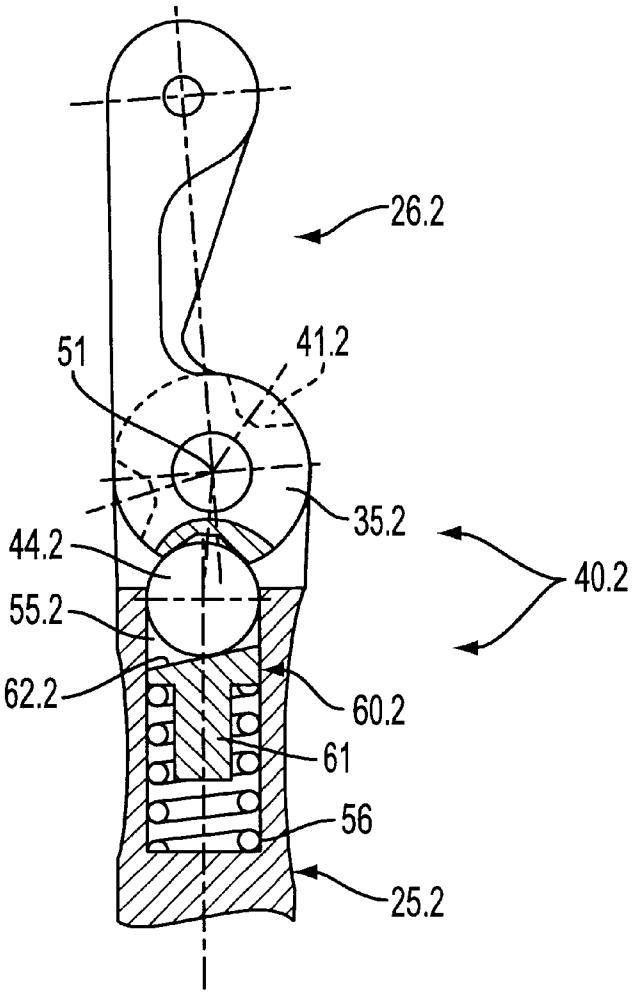
Figure 14:
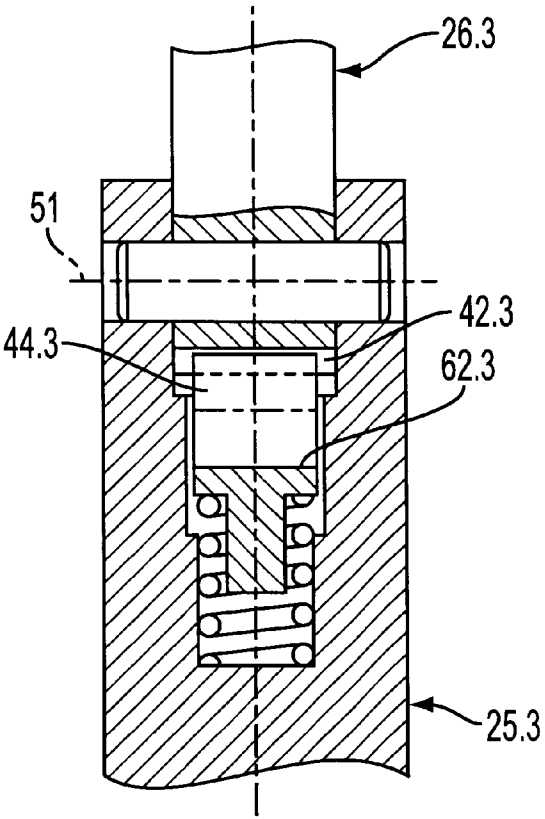
Figure 13:
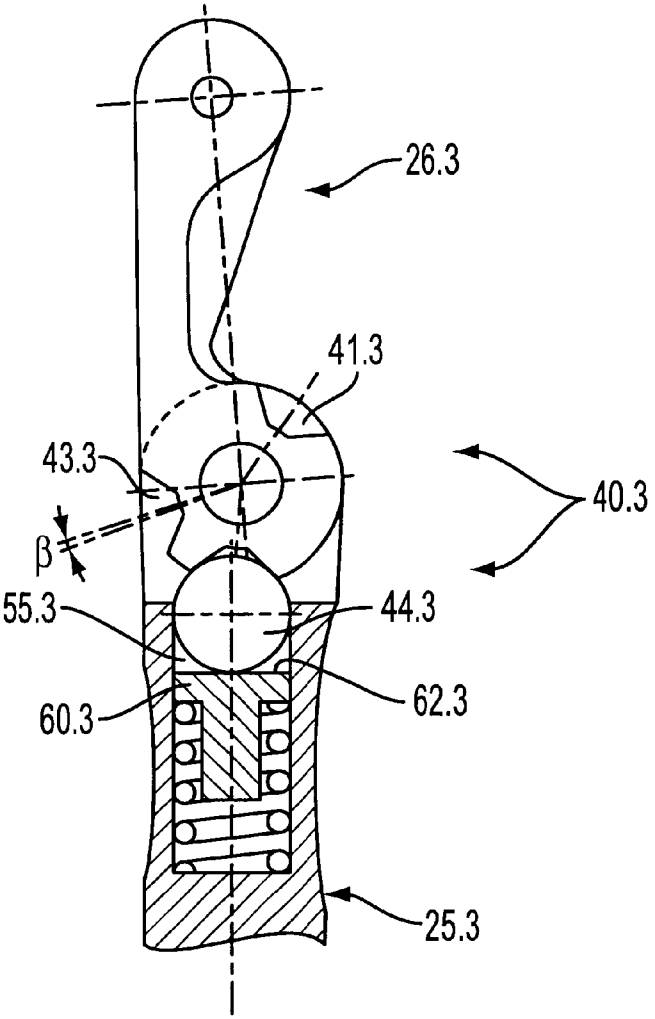
Figure 16:
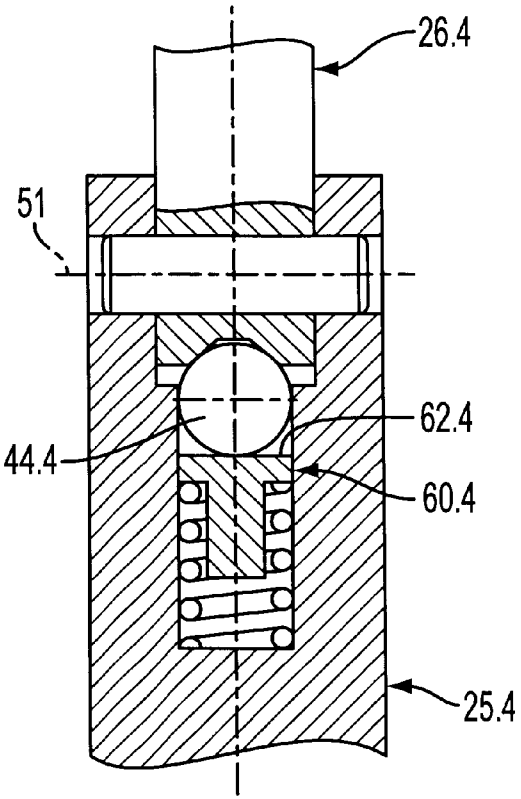
Figure 15:
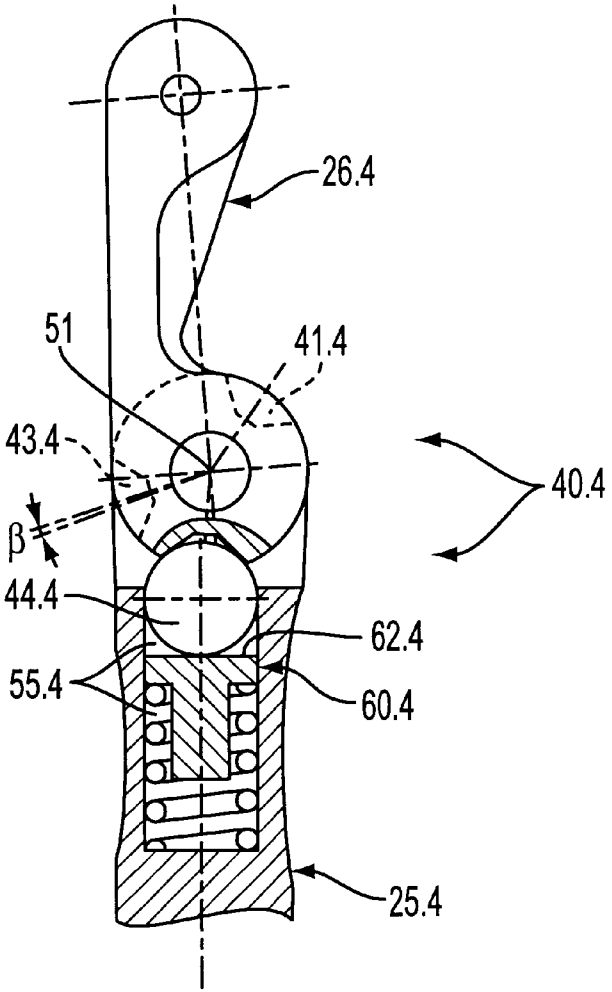

The invention we [[sic]] explained in more detail hereinbelow with reference to a plurality of exemplary embodiments illustrated in the drawings, in which:

FIG. 1 shows a plan view of an adjusting device together with in each case one cross section, illustrated in detail form, of the border region of a window opening and of the associated hinged window panel with three different positions of the hinged window panel;

FIGS. 2 to 4 each show a plan view of the adjusting device according to FIG. 1 in each case one of the three adjusting positions;

FIGS. 5 to 7 each show a side view of three different embodiments of a link of the adjusting device;

FIGS. 8 and 9 each show a vertical projection, illustrated partly in section, of the hinge parts of a first exemplary embodiment of a hinge joint with latching device;

FIGS. 10 and 11 each show a vertical projection, illustrated partly in section, of the hinge parts of a second exemplary embodiment of a hinge joint with latching device;

FIG. 12 shows a horizontal section, illustrated in detail form, of the adjusting device along section line 11—11 in FIG. 10;

FIGS. 13 and 14 each show a vertical projection, illustrated partly in section, of the hinge parts of a third exemplary embodiment of a hinge joint with latching device;

FIGS. 15 and 16 each show a vertical projection, illustrated partly in section, of the hinge parts of a fourth exemplary embodiment of a hinge joint with latching device.

FIGS. 1 to 4 show an adjusting device 20 by means of which a hinged window 21 can be adjusted to three different positions in relation to the bodywork part 22 of a motor vehicle, in particular of a passenger vehicle.

FIGS. 1 and 2 illustrate the closed position of the hinged window 21, in which the border region of the hinged window 21 butts against a sealing profile 23, which is arranged along the inner border of the window opening 24 of the bodywork part 22. The window opening 24 is closed off by the hinged window 21 butting against the sealing profile 23 in this way. FIG. 3 illustrates a central open position and FIG. 4 illustrates the furthest open position, of the hinged window 21.

As can be seen, in particular from FIG. 3, the adjusting device 20 knows [sic] an elongate basic body 25, a link 26, an actuating lever 27 and a connecting strap 28. Of these four parts of the adjusting device 20, in each case two are connected to one another in an articulated manner by a hinge joint, to be precise the basic body 25 and the link 26 are connected by the first hinge joint 31, the link 26 and the actuating lever 27 are connected by the second hinge joint 32, and the actuating lever 27 and the connecting strap 28 are connected by the third hinge joint 33.

The elongate basic body 25 is provided, at the end located on the left-hand side in FIG. 3, with fastening elements (not illustrated) in the form of screw holes for fastening screws, by means of which the basic body is fastened on the bodywork part 22. At its other end, the basic body is designed as one hinge part 34 of the first hinge joint 31. The link 26 is designed, at one end, as the other hinge part 35 of the first hinge joint 31. At its other end, it is designed as one hinge part 36 of the second hinge joint 32. The actuating lever 27 is designed as a two-sided lever. At one end, it is designed as a hinge part of the third hinge joint 33. At a location remote from said hinge part, it is designed as the other hinge part of the second hinge joint 32. The connecting strap 28 is designed, at one end, as the other hinge part of the third hinge joint 33. At its other end, it has fastening elements for fastening on the hinged window 21. For this purpose, the connecting strap 28 has an angled length section 37 which, for fastening to the hinged window 21, is provided with a fastening element in the form of a threaded hole. Screwed into the latter is the threaded shank of a fastening screw 38, which is fitted through a matching through-hole in the hinged window 21.

Since some of the parts described above and also some parts which will be described hereinbelow are suitable for four different embodiments of the adjusting device 20, a differentiating-numeral suffix is added, after a point, to the designations of these parts in the drawings and indicates the corresponding embodiment of the adjusting device in the order in which they are described hereinbelow. These differentiating numerals are omitted from the description itself in order that the latter can be read more straightforwardly.

The adjusting device 20 is provided with a latching device 40 for the three latching positions which can be seen from FIGS. 2 to 4. The latching device 40 is expediently arranged on the first hinge joint 31.

The latching device 40 has, corresponding to the three latching positions, three latching notches 41, 42 and 43 (FIG. 5), which interact with a latching body 44 (FIGS. 8 and 9).

As can be seen from FIGS. 8 and 9, the first hinge joint 31 is designed as a fork joint. Its two joint lugs 45 and 46 are arranged on the hinge part 34 of the basic body 25. They are separated from one another by a slot 47, of which the clear width is coordinated with the thickness of the hinge part 35 at one end of the link 26, which extends in the interspace between the two joint lugs 45 and 46. The two joint lugs 44 [[sic]] and 45 are each provided with a cylindrical through-hole 48, the two through-holes being aligned with one another. The hinge part 35 of the link 26 is likewise provided with a cylindrical through-hole of the same diameter. A cylindrical joint pin 49 is inserted in to said through-holes.

Each of the latching notches 41 . . . 43 on the hinge part 35 of the link 26 is designed as an axially continuous groove which is aligned parallel to the hinge axis 51 of the hinge joint 31. Its vertical projection is the same as the vertical projection of a truncated cone. The cone angle is an obtuse angle of at least more or less 100°. The line of symmetry 52 of the latching notches 41 . . . 43 is aligned with a radial line 53 from the hinge axis 51 of the hinge joint 31. The side walls of the groove form the abutment surfaces for the latching body 44.

The latching body 44 is designed as a latching roller, of which the longitudinal axis 54 is aligned parallel to the hinge axis 51 of the hinge joint 31. The latching body 44 is guided displaceably on the hinge part 34 by means of a longitudinal guide which is aligned with a radial line from the hinge axis 51 of the hinge joint 31. This longitudinal guide is formed by a recess 55 which is arranged in the basic body 25 and adjoins the slot 47. The recess 55 has a clear cross section which is coordinated with the horizontal projection of the latching body 44 which, in the case of the roller-like latching body 44, is thus rectangular.

The latching body 44 is subjected to the action of a pressure-exerting spring 56 in the form of a cylindrical helical compression spring, which is seated and guided in a matching cylindrical recess 57, which adjoins the rectangular recess 55 for the latching body 44 and is aligned therewith.

A spring plate 60 is arranged between the pressure-exerting spring 56 and the latching body 44. The cross-sectional shape of the spring plate is coordinated with the recess 55 for the latching body 44, and is thus rectangular. The spring plate 60 is adjoined by a cylindrical guide pin 61, which is coordinated with the clear dimensions of the pressure-exerting spring 56 and extends, in part, into the interior of said spring.

The top side of the spring plate 60, said top side being directed toward the latching body 44, serves as an abutment surface 62 for the latching body 44. The abutment surface 62 is planar. The normals to the abutment surface 62 are inclined, in a plane aligned perpendicularly to the hinge axis 51, by an angle in relation to the alignment of the longitudinal guide of the latching body 44, i.e. in relation to the alignment of the recess 55. This angle of inclination is at least more or less 15°.

This oblique positioning of the abutment surface 62 results in the force of the pressure-exerting spring 56 on the latching body 44 acting in alignment with the hinge axis 51 being divided up [[lacuna]] a force component aligned in the direction of the radial line in relation to the hinge axis 51 and into a force component aligned perpendicularly thereto. The last-mentioned force component causes the latching body 44 to be pressed onto that side surface of its longitudinal guide, i.e. of the recess 55, which is located in the direction of the slope of the abutment surface 62. Said force thus causes the latching body 44 to butt against one side of its longitudinal guide. Since it butts, at the same time, against the two side surfaces of the relevant latching notch 41 . . . 43, the link 26 is secured in this "abutment position" as long as the retaining moment to which it is subjected by the latching body 44 is greater than a load moment to which it is subjected by the hinged window 21 via the hinge part 36. By a suitable selection of the parameters, and in particular, the angle of inclination of the abutment surface 62 and the force of the pressure-exerting spring 56, it is possible, within certain limits, to avoid vibratory movements and resulting disruptive noise of the hinged window 21.

Since the relative wind subjects an open hinged window to a force in the closing direction, it is expedient for the abutment surface 62 to be inclined such that the retaining moment of the latching device 40 in the closing direction of the hinged window 21 is greater than in the opening direction.

A second embodiment of the adjusting device 20 with the latching device 40.2 is explained in more detail hereinbelow, with reference to FIGS. 6 and 10 to 12. If individual subassemblies or components are not explained separately hereinbelow, it should be assumed that they are the same as, or at least similar to, the corresponding subassemblies and components of the embodiment which has been explained above.

The modification of the latching device 40.2 in relation to the latching device 40.1 lies essentially in the shape of the latching notches 41.2 . . . 41.2 [[sic]] and of the parts which interact directly therewith.

The latching body 44.2 is designed as a latching ball. The latching notches 41.2 . . . 43.2 on the hinge part 35.2 of the link 26.2 are designed as recesses in the form of a hollow truncated cone, of which the dimensions are coordinated with the dimensions of the latching ball 44.2. The circumferential wall of the truncated cone serves as abutment surface for the latching ball 44.2. The cone angle of the latching notches is an obtuse angle of at least more or less 100°.

On account of the latching body 44.2 being in the form of a ball, its longitudinal guide is formed by a circular-cylindrical recess 55.2. This serves, at the same time, as a guide for the pressure-exerting spring 56.

The spring plate 60.2 has a circular horizontal projection, which is coordinated with the recess 55.2. Its circular-cylindrical guide pin 61 projects, in part, into the interior of the pressure-exerting spring 56.

The top side of the spring plate 60, said top side being directed toward the latching ball 44.2, serves once again as an abutment surface 62.2 for the latching ball 44.2. This abutment surface 62.2 is planar. It is inclined obliquely about a line parallel to the hinge axis 51. The normals to the abutment surface 62.2 are inclined by at least more or less 15° in relation to the alignment of the longitudinal guide 55.2 of the latching ball 44.2.

In order that the abutment surface 62.2, despite the round horizontal projection of the spring plate 60.2, always maintains the same alignment, the spring plate 60.2 is provided with a rotation-prevention means 65. One part of the rotation-prevention means is formed by a groove 66 which is arranged on the inside of the recess 55.2, which serves as the longitudinal guide for the latching ball 44.2, and is aligned parallel to the axis of said longitudinal guide. The other part of the rotation-prevention means 65 is formed by a continuation 67 on the spring plate 60.2, of which the horizontal projection is coordinated with the horizontal projection of the groove 66.

The latching device 40.3 as the third embodiment is explained hereinbelow with reference to FIGS. 7, 13 and 14. If individual subassemblies or components are not explained separately, it should also be assumed here that they are the same as, or at least similar to, the corresponding subassemblies or components of the embodiments which have been explained above.

The modification of the latching device 40.3 in relation to the latching device 40.1 resides essentially in that the lateral force component for the latching body 44.3 is produced differently.

The longitudinal guide for the roller-like latching body 44.3 is formed by the recess 55.3, which has a rectangular horizontal projection coordinated with the roller shape of the latching body 44.3. The spring plate 60.3 has a corresponding rectangular horizontal projection. Its abutment surface 62.3 for the latching body 44.3 is of planar design and is aligned normal to the axis of the longitudinal guide 55.3.

The latching notches 41.3 . . . 43.3 which interact with the latching body 44.3 are each designed as an elongate groove, the grooves being aligned parallel to the hinge axis 51 and their vertical projection being the same as the vertical projection of a truncated cone (FIG. 7). The line of symmetry of the vertical projection of the latching notches 41.3 . . . 43.3 is inclined by an angle $\beta$, which is at least more or less 5.5°, in relation to the radial line from the hinge axis 51. The direction of inclination of the line of symmetry of the vertical projection of the latching notches in relation to the radial line from the hinge axis 51 is also selected here such that the necessary adjusting force on the hinged window 21 in the direction of the closed position (FIG. 2) is greater than in the direction of the open position (FIGS. 3 and 4).

The latching device 40.4 as the fourth embodiment is explained hereinbelow with reference to FIGS. 15 and 16. If individual subassemblies or components are not explained separately, it should also be assumed here that they are the same as, or at least similar to, the corresponding subassemblies or components of the embodiments which have been explained above.

The modification of the latching device 40.4 in relation to the latching device 40.2 (FIGS. 6, 10 and 11) is essentially analogous to the modification of the latching device 40.3 in relation to the latching device 40.1.

The latching body 44.4 is designed as a latching ball which is guided in a longitudinally displaceable manner in the circular-cylindrical recess 55.4. The round spring plate 60.4 is likewise guided therein. Its abutment surface 55.4 for the latching ball 44.4 is planar and aligned normal to the axis of the longitudinal guide 55.4. The spring plate 60.4 does not have any rotation-prevention means.

The latching notches 41.4 . . . 43.4 are designed as recesses in the form of a hollow truncated cone, as is the case with the latching notches 41.2 . . . 43.2. The cone axis of the latching notches 41.4 . . . 43.4 is inclined, in a plane aligned perpendicularly to the hinge axis 51, by the angle $\alpha$ in relation to the radial line from the hinge axis 51. Tests have proven an angle $\alpha$ of at least more or less 5.5° to be particularly advantageous.

As can be seen from FIG. 1, the pivoting angle of the hinged window 21 between the closed position and the first open position is at least more or less equal to the pivoting angle between the first and the second open positions. In order to achieve this, the center angle of the radial lines of in each case two adjacent latching notches 41 . . . 43 have [[sic]] to be coordinated with the configuration of the parts of the adjusting device and the dimensions thereof. This means in the present case, that the center angle between the radial lines of the first and of the second and of the third latching notches 42 and 43, respectively.

In the case of the latching devices 40.2 and 40.4 with a respective latching body 44.2 and 44.4 in the form of a ball, axially continuous grooves, as are used for the roller-like latching bodies 44.1 and 44.3, may also be provided for the latching notches 41 . . . 43 instead of the frustoconical recesses.

List of Designations

20 Adjusting device
21 Hinged window
22 Bodywork part
23 Sealing profile
24 Window opening
25 Basic body
26 Link
27 Actuating lever
28 Connecting strap
31 First hinge joint
32 Second hinge joint
33 Third hinge joint
34 Hinge part
35 Hinge part
36 Hinge part
37 Length section
38 Fastening screw
40 Latching device
41 Latching notch
42 Latching notch
43 Latching notch
44 Latching body
45 Joint lug
46 Joint lug
47 Slot
48 Through-hole
49 Joint pin
51 Hinge axis
52 Line of symmetry
53 Radial line
54 Longitudinal axis
55 Recess
56 Pressure-exerting spring
57 Recess
60 Spring plate
61 Guide pin
62 Abutment surface
65 rotation-prevention means
66 groove
67 continuation

What is claimed is:

1. Adjusting device for hinged windows, having the following features:

an elongate basic body is provided,
- which is provided, at one end, with fastening elements for fastening on a stationary part of the motor vehicle and
- which is designed, at its other end, as one hinge part of a first hinge joint, a link is provided,
- which is designed, at one end, as the other hinge part of the first hinge joint, and
- which is designed, at its other end, as one hinge part of a second hinge joint, an actuating lever is provided
- which is designed, at one end, as one hinge part of a third hinge joint, and
- which is designed, at a location remote from said hinge part, as the other hinge part of the second hinge joint, a connecting strap is provided,
- which is designed, at one end, as the other hinge part of the third hinge joint, and
- which has, at its other end, fastening elements for fastening on the hinged window, a latching device for at least two latching positions is provided on the first hinge joint or on the second hinge joint, the latching device has a latching body
- which is guided displaceably on one hinge part by means of a longitudinal guide, and
- which is subjected to a pressure-exerting spring acting in the direction of the other hinge part, the latching device has, for each latching position, a latching notch which is arranged on the other hinge part in alignment with the movement path of the latching body, characterized by the following features:

the latching body is designed as a latching roller, of which the longitudinal axis is aligned parallel to the hinge axis of the hinge joint, each latching notch is designed as an elongate groove
- which is aligned parallel to the hinge axis,
- of which the vertical projection is the same as the vertical projection of a cone or of a truncated cone, and
- of which the side walls serve as abutment surfaces for the latching body, the line of symmetry of the vertical projection of the latching notch is aligned with a radial line from the hinge axis of the hinge joint, arranged between the latching body and its pressure-exerting spring is a spring plate,
- which is guided by the longitudinal guide of the latching body, and
- which has an abutment surface for the latching body, the normals to the abutment surface are inclined, in a plane aligned perpendicularly to the hinge axis of the hinge joint, by an angle in relation to the alignment of the longitudinal guide of the latching body.

2. Adjusting device for hinged windows, having the following features:

an elongate basic body is provided,
- which is provided, at one end, with fastening elements for fastening on a stationary part of the motor vehicle and
- which is designed, at its other end, as one hinge part of a first hinge joint, a link is provided,
- which is designed, at one end, as the other hinge part of the first hinge joint, and
- which is designed, at its other end, as one hinge part of a second hinge joint, an actuating lever is provided
- which is designed, at one end, as one hinge part of a third hinge joint, and which is designed, at a location remote from said hinge part, as the other hinge part of the second hinge joint, a connecting strap is provided, which is designed, at one end, as the other hinge part of the third hinge joint, and which has, at its other end, fastening elements for fastening on the hinged window, a latching device for at least two latching positions is provided on the first hinge joint or on the second hinge joint, the latching device has a latching body which is guided displaceably on one hinge part by means of a longitudinal guide, and which is subjected to a pressure-exerting spring acting in the direction of the other hinge part, the latching device has, for each latching position, a latching notch which is arranged on the other hinge part in alignment with the movement path of the latching body, characterized by the following features:

the latching body is designed as a latching ball, the latching notch is designed as a recess in the form of a hollow cone, truncated cone or elongated groove, wherein if the latching notch is designed as a hollow cone or truncated cone the circumferential wall serves as an abutment surface for the latching body, the cone axis of the latching notch is aligned with a radial line from the hinge axis of the hinge joint, arranged between the latching body and its pressure-exerting spring is a spring plate which is guided by the longitudinal guide of the latching body, which has an abutment surface for the latching body, and which is provided with a rotation-prevention means, the normals to the abutment surface are inclined, in a plane aligned perpendicularly to the hinge axis of the hinge joint, by an angle in relation to the alignment of the longitudinal guide of the latching body.

3. Adjusting device for hinged windows, having the following features:

an elongate basic body is provided, which is provided, at one end, with fastening elements for fastening on a stationary part of the motor vehicle and which is designed, at its other end, as one hinge part of a first hinge joint, a link is provided, which is designed, at one end, as the other hinge part of the first hinge joint, and which is designed, at its other end, as one hinge part of a second hinge joint, an actuating lever is provided which is designed, at one end, as one hinge part of a third hinge joint, and which is designed, at a location remote from said hinge part, as the other hinge part of the second hinge joint, a connecting strap is provided, which is designed, at one end, as the other hinge part of the third hinge joint, and which has, at its other end, fastening elements for fastening on the hinged window, a latching device for at least two latching positions is provided on the first hinge joint or on the second hinge joint, the latching device has a latching body which is guided displaceably on one hinge part by means of a longitudinal guide, and which is subjected to a pressure-exerting spring acting in the direction of the other hinge part, the latching device has, for each latching position, a latching notch which is arranged on the other hinge part in alignment with the movement path of the latching body, characterized by the following features:

the latching body is designed as a latching roller, of which the longitudinal axis is aligned parallel to the hinge axis of the hinge joint, each latching notch is designed as an elongate groove which is aligned parallel to the hinge axis, of which the vertical projection is the same as the vertical projection of a cone or of a truncated cone, and of which the side walls serve as abutment surfaces for the latching body, the line of symmetry of the vertical projection of the latching notch is inclined by an angle in relation to the radial line from the hinge axis of the hinge joint, arranged between the latching body and its pressure-exerting spring is a spring plate which is guided by the longitudinal guide of the latching body, and which has an abutment surface for the latching body.

4. Adjusting device for hinged windows, having the following features:

an elongate basic body is provided, which is provided, at one end, with fastening elements for fastening on a stationary part of the motor vehicle and which is designed, at its other end, as one hinge part of a first hinge joint, a link is provided, which is designed, at one end, as the other hinge part of the first hinge joint, and which is designed, at its other end, as one hinge part of a second hinge joint, an actuating lever is provided which is designed, at one end, as one hinge part of a third hinge joint, and which is designed, at a location remote from said hinge part, as the other hinge part of the second hinge joint, a connecting strap is provided, which is designed, at one end, as the other hinge part of the third hinge joint, and which has, at its other end, fastening elements for fastening on the hinged window, a latching device for at least two latching positions is provided on the first hinge joint or on the second hinge joint, the latching device has a latching body which is guided displaceably on one hinge part by means of a longitudinal guide, and which is subjected to a pressure-exerting spring acting in the direction of the other hinge part, the latching device has, for each latching position, a latching notch which is arranged on the other hinge part in alignment with the movement path of the latching body, characterized by the following features:

the latching body is designed as a latching ball, the latching notch is designed as a recess in the form of a hollow cone or truncated cone, of which the circumferential wall serves as an abutment surface for the latching body, the cone axis of the latching notch is inclined, in a plane aligned perpendicularly to the hinge axis of the hinge joint, by an angle in relation to the radial line from the hinge axis of the hinge joint, arranged between the latching body and its pressure-exerting spring is a spring plate, which is guided by the longitudinal guide of the latching body, and which has an abutment surface for the latching body.

5. Adjusting device according to claim 1, characterized by the following features:

the cone angle of the latching notch or of the vertical projection thereof is an obtuse angle, the cone angle is preferably at least more or less 100°.

6. Adjusting device according to claim 1, characterized by the following features:

the angle of inclination by which the normals to the abutment surface on the spring plate is inclined in relation to the alignment of the longitudinal guide of the latching body is at least more or less 15°.

7. Adjusting device according to claim 3, characterized by the following feature:

the angle of inclination by which the line of symmetry of the vertical projection or of the cone axis of the latching notch is inclined in relation to the radial line from the hinge axis of the hinge joint is at least more or less 5.5°.

8. Adjusting device according to claim 6, characterized by the following feature:

the normals to the abutment surface on the spring plate or the line of symmetry of the vertical projection or the cone axis of the latching notch is/are inclined to that side in which the adjusting force in the direction of the closed position is greater than in the direction of the open position of the hinged window.

9. Adjusting device according to claim 1, characterized by the following features:

the latching device has three latching notches, the angle between the radial line of the first and of the second latching notches is preferably greater than the angle between the radial line of the second and the third latching notches.

10. Adjusting device according to claim 2, characterized by the following features:

each latching notch is designed as an elongate groove, which is aligned parallel to the hinge axis, of which the vertical projection is the same as the vertical projection of a cone or of a truncated cone, and of which the side walls serve as abutment surfaces for the latching body.

11. Adjusting device according to claim 7, characterized by the following feature:

the normals to the abutment surface on the spring plate or the line of symmetry of the vertical projection or the cone axis of the latching notch is/are inclined to that side in which the adjusting force in the direction of the closed position is greater than in the direction of the open position of the hinged window.

* * * * *